United States Patent [19]

Tsushima

[11] 4,430,402

[45] Feb. 7, 1984

[54] DICHROMATIC ELECTROPHOTOGRAPHY USING TWO DEVELOPER COMPOSITIONS APPLIED SEQUENTIALLY

[75] Inventor: Shuichi Tsushima, Tokyo, Japan

[73] Assignee: Ricoh Co., Ltd., Tokyo, Japan

[21] Appl. No.: 393,235

[22] Filed: Jun. 29, 1982

Related U.S. Application Data

[62] Division of Ser. No. 172,732, Jul. 28, 1980, abandoned.

[30] Foreign Application Priority Data

Aug. 2, 1979 [JP] Japan ..... 54-99216

[51] Int. Cl.[3] ..... G03G 13/01; G03G 13/08; G03G 13/22

[52] U.S. Cl. ..... 430/45; 430/100; 430/108; 430/109; 430/120

[58] Field of Search ..... 430/45, 120, 121, 54, 430/57, 100

[56] References Cited

U.S. PATENT DOCUMENTS

| | | | |
|---|---|---|---|
| 3,060,020 | 10/1962 | Greig | 430/120 X |
| 3,901,698 | 8/1975 | Fukushima et al. | 430/100 |
| 3,926,824 | 12/1975 | Lipani | 430/54 X |
| 4,250,239 | 2/1981 | Sakai | 430/57 X |

*Primary Examiner*—John D. Welsh

*Attorney, Agent, or Firm*—Flynn, Thiel, Boutell & Tanis

[57] ABSTRACT

A two-component type dry developer for use in dichromatic electrophotography comprising two kinds of developers, said developers each consisting of a toner and a carrier therefor and adapted for the production of a dichromatic image by developing a both positively and negatively electrified electrostatic latent image successively with toners different in polarity and color from each other, wherein one carrier has a triboelectrification property of being electrified positively by friction with either of two toners while the other carrier has a triboelectrification property of being electrified negatively by friction with either of two toners.

1 Claim, 8 Drawing Figures

DICHROMATIC ELECTROPHOTOGRAPHY USING TWO DEVELOPER COMPOSITIONS APPLIED SEQUENTIALLY

This is a division of application Ser. No. 172,732 filed July 28, 1980, now abandoned.

BACKGROUND OF THE INVENTION (a) Field of the Invention

This invention is broadly concerned with a two component type dry developer for use in dichromatic electrophotography and particularly concerned with two kinds of developers wherein there exists a specific relation between toners and carriers therefor.

(b) Description of the Prior Art

Conventionally, the cycling process comprising electrification-exposure-development-transfer has been repeated in order to obtain a dichromatic image by using an electrophotographic photosensitive element with the undesirable result that a shear in the image is caused and accordingly a clear-cut copy is not obtainable.

In U.S. Pat. No. 3,236,639 there is further proposed a three component type developer comprising mixing with carrier particles, two kinds of toner particles, which are different in color from each other and are triboelectrifiable with a polarity opposite to each other. However, such a three component developer is defective in that said developer is apt to bear a mixed color because it is originally used in a combined manner, thereby hampering the production of a clear-cut dichromatic image, and further such a developer is unable to exhibit a satisfactory developing stability because the friction stability of the toner used is inferior.

To cope with this, public attention is now focused on a process for the production of a dichromatic image comprising the steps of forming a both positively and negatively electrified electrostatic latent image on one photosensitive element, developing said latent image successively with separate developers which are different in charged polarity from each other (namely, two kinds of developers which are different in charged polarity from each other), and then transferring the resulting toner image onto a common paper or the like.

Even the so-called two component type developing system for use in dichromatic electrophotography, which comprises developing an electrostatic latent image formed by means of this positive and negative electrification successively with toners which are different in polarity and color from each other, however, is noted to suffer from the problem that occasionally the toner provided on the photosensitive element by an earlier development is scraped off upon effecting a subsequent development. The occurrence of this scraping-off phenomenon not only deteriorates the density of the image tinted with the earlier developed color but also induces the toner thus scraped off to mingle in the developer used in subsequent development, which latter developer contains toner tinted with a different color than the first-used developer, whereby the electrified state of the toner contained in this developer (namely, the developer used in the subsequent development) is disturbed and ultimately the image quality is widely deteriorated thereby.

SUMMARY OF THE INVENTION

Accordingly, it is an object of this invention to provide a two component type dry developer which is capable of overcoming the aforesaid defects inherent in the conventional two-component type developing system and is able consistently to produce an excellent dichromatic image.

In particular, this invention is directed toward a two component type dry developer comprising two kinds of developers, said developers each consisting of a toner and a carrier therefor and adapted for the production of a dichromatic image by development of a both positively and negatively electrified electrostatic latent image successively with toners different in polarity and color from each other, wherein one carrier has a triboelectrification property of being electrified positively by friction with either of the two toners while the other carrier has a triboelectrification property of being electrified negatively by friction with either of the two toners.

Elucidating this invention in more detail, the developer according to this invention is defined as a two component type dry developer adapted for developing a both positively and negatively electrified latent image formed on a photosensitive element, an electrostatic recording material or the like successively with two kinds of toner that are electrified positively or negatively and different in color from each other.

The methods which may be used for the formation of the both positively and negatively electrified latent image referred to herein include (1) the method of forming a latent image on an electrostatic recording material by a needle-electrode or the like, or (2) the method of forming a latent image by a process of applying for instance a positive or negative first corona electrification onto a composite photosensitive element comprising laminated photoconductive layers of photosensitivity different from each other and then subjecting the same to a second corona electrification with a polarity opposite to that of the first electrification or a process of uniformly exposing said composite photosensitive element to a light of wavelength capable of making said upper side photoconductive layer or lower side photoconductive layer conductive after or simultaneously with the first corona electrification, and successively applying the second corona electrification thereto, thereby charging each of said photoconductive layers so as to retain a different polarity respectively; and then exposing the element to light through an original (as disclosed in Japanese Laid-open Patent Application No. 112634/1979).

The two component type dry developer (which is sometimes referred to as "developer" for short, hereinafter) is generally comprised of carrier and toner, wherein said carrier and toner are each charged with an opposite polarity by repeated frictional contacts therebetween.

Now, considering an example wherein the positively charged latent image portion of an electrostatic latent image charged with both positive and negative polarities is first developed with, for instance, a negatively charged red toner (a first development) and then the negatively charged latent image portion is developed with a positively charged black toner (a second development), the red toner on the previously developed photosensitive element (or electrostatic recording material) is scraped off at the time of effecting the second development, in other words when development with said black toner is carried out. The amount of the red toner thus scraped off varies depending on the conditions for the second development, that is, for the development using the black toner. The scraped off toner normally comes to mingle in a second developing device. After the first and second developing operations are completed and the resulting toner image is transferred to a paper or the like, the photosensitive element or electrostatic recording material is cleaned by means of a fur brush or the like, but in cases where this cleaning is imperfect the residual black toner on the photosensitive element or the like is scraped off at the time when the next first development is effected and thus mingles in the red developer.

In light of the occurrence of such problems, the present inventor employed two kinds of developers having the triboelectrification series as illustrated in FIG. 1, said developers comprising a black developer consisting of a black toner and a carrier therefor and a red developer consisting of a red toner and a carrier therefor, and mingled the red toner little by little in the black developer to thereby measure the charge amount of said red toner by means of a blow-off process for the purpose of investigating the influence produced by the red toner thus mingled. In this connection, it is to be noted that the triboelectrification series illustrated in FIG. 1 indicates that between the toners and the carriers there exist relations such that the black toner is electrified positively by friction with both the carrier for the black toner and the carrier for the red toner, while the red toner is electrified negatively by friction with both the carriers, and further, the carrier for the black toner is electrified positively and the carrier for the red toner is electrified negatively respectively by mutual friction between the carriers.

The measurement showed that the black toner content in the black developer was 3% by weight and the charge amount of the black toner prior to the mixing of the red toner was +7 μc/g.

It is noted from the measurement results shown in FIG. 7 that the charge amount of the toner as a whole decreases as the amount of the red toner mixed therein increases. The positive and negative electrostatic latent image portions, the surface potentials thereof being +600 V and −600 V respectively, were developed with the black developer of FIG. 7 in which the mixing ratio of the red toner was (1) 30% by weight, and (2) zero % by weight (wherein said ratio is expressed in both cases in relation to the black toner). The results showed that the black developer in which the mixing ratio of the red toner was zero, in other words which was free from the red toner, could develop the negative latent image portion alone but entirely failed to develop the positive latent image portion. In contrast thereto, the image obtained by the use of the developer containing the red toner in a mixing ratio of 30% by weight showed that the negative latent image portion was deteriorated in density as compared with the former case, while the positive latent image portion displayed a state wherein the black toner mingled slightly in the red toner.

It can be inferred from this Experiment-1 that the developer used herein (the developer wherein the triboelectrification series is in such a relation as illustrated in FIG. 1), the red toner mixed in remains charged negatively, while the greater part of the black toner holds its normal polarity (positive polarity) but the remaining part thereof changes its polarity.

Since the polarity of the red toner, mostly or entirely, does not change as stated above, in a case where a both positively and negatively charged latent image is first developed with red developer and then with black developer mixed with said red toner, the red toner mixed in the black developer is scarcely consumed because the positive latent image has already been developed with the red toner and accordingly remains stored in the black developer.

This tendency can be perceived likewise in the case where development is effected in reverse order by the use of two kinds of developers which are of the triboelectrification series as illustrated in FIG. 2, namely, in the case of developing first with the black developer and then with the red developer.

In view of this problem, there arises the necessity of removing the red toner that is mixed in the black developer to some degree. The present inventor carried out the same experiment as aforesaid by using two kinds of developers which are of the triboelectrification series as illustrated in FIG. 3. This triboelectrification series illustrated in FIG. 3 implies that the red toner is electrified negatively by friction with the carrier for the red toner but is electrified positively by friction with the black toner or the carrier therefor, while the black toner is electrified negatively by friction with the red toner or the carrier therefor but is electrified positively by friction with the carrier for the black toner.

The results obtained from this experiment with reference to the charge amount of the toner as a whole in the black developer mixed with the red toner are shown in FIG. 8. The amount of the black toner present in the black developer was 3% by weight also in this case, but the charge amount of the black toner prior to the mixing of the red toner was +80 μc/g. As seen from measurement results-2, the charge amount of the toner as a whole scarcely changes even when the amount of the red toner mixed therein increases. The positive and negative electrostatic latent image portions, the surface potential thereof being +600 V and −600 V respectively, were developed with the developer in this state, namely with the black developer of FIG. 8 in which the mixing ratio of the red toner was (1) 30% by weight, and (2) zero (wherein said ratio is expressed in both cases in relation to the black toner). The obtained results showed that the black developer which was free from the red toner could develop the negative latent image portion alone but entirely failed to develop the positive latent image portion. On the other hand, when the developer in which the mixing ratio of the red toner was 30% by weight was used there was obtained a black image, the negative latent image portion thereof being slightly mingled with the red toner, and the positive latent image portion thereof being not developed.

The tendencies as described with reference to FIG. 3 and FIG. 8 are perceivable likewise in the use of the developer having the triboelectrification series as shown in FIG. 4 and further in the use of developers having the triboelectrification series as shown in FIG. 5 and FIG. 6 reversing the developing order (namely, in the case of developing first with the black developer and then with the red developer).

To sum up, the common feature present among the dichromatic developers described by FIG. 3 to FIG. 6 is that between both toners there exists such a relation that one carrier is electrified positively by friction with either of red and black toners and the other carrier is electrified negatively by friction with either of said both toners.

It can be inferred from this Experiment-2 that the previously negatively charged red toner, upon mixing in the black developer, has changed to have the opposite polarity, namely positive polarity. In this case, accordingly, the red toner, upon mixing in the black developer, changes its polarity into the same polarity as that of the black toner and therefore attaches itself to the area to which the black toner originally attaches and is developed. However, when the amount of the red toner mixed in the black developer is trifling, the red toner, even if it attaches to the black image area, is scarcely perceivable. In addition thereto, since the mixed red toner changes its polarity and is consumed gradually for developing purposes, an extremely small amount of the red toner is stored in the black developer.

The developer which may be used in this invention can be prepared in practice by selecting the materials so that the triboelectrification series takes a pattern consisting of negative carrier-positive toner-negative toner-positive carrier (or positive carrier-negative toner-positive toner-negative carrier) and then preparing two kinds of dry developers by means of a conventional well known process.

As the carriers suitable for negative triboelectrification, generally, there can be enumerated those prepared by coating iron powders with fluoro resin, polyvinyl chloride, polyvinylidene chloride, phenol resin, polyvinyl acetal, etc., and as carriers suitable for positive triboelectrification there can be enumerated those prepared by coating iron powders with polyamide, polyaminostyrene, styreneacryl copolymer, etc. Toners which may be used in this invention include those obtained by coloring resins such as styrene, acryl, epoxy, polyester, etc., with carbon black and other pigments such as carmine type pigments, rhodamine type pigments, quinocridone type pigments, etc.

As mentioned above, this invention discloses a developer for use in dichromatic electrophotography comprising two kinds of two component type dry developers characterized in that one carrier has a triboelectrification property of being electrified positively by friction with either of the two toners while the other carrier has a triboelectrification property of being electrified negatively by friction with either of the two toners. Due to this, should a toner happen to become mixed in the other developer in which it originally was not mixed, the mixed toner is caused to have the same polarity as that of the toner previously present in that developer in relation with the carrier therein and is immediately consumed for the developing purposes, thereby leaving no possibility of accumulating therein. Further, the developer according to this invention does not suffer from concentration deterioration even when applied for the purpose of continuously producing a multiplicity of copies. In fact, when a multiplicity of copies was obtained by developing a positively and negatively electrified electrostatic latent image by means of two kinds of developers having the triboelectrification series illustrated in FIG. 1 (Control) and two kinds of developers having the triboelectrification series illustrated in FIG. 3 (the invention), it was observed that in the case of the control developer, approximately the 4000th copy showed that the density of the black image area had deteriorated and the red image area was mingled with the black toner, while in the case of the developer according to this invention even the 8000th copy suffered from no changes in image quality and accordingly still retained its clearness.

DESCRIPTION OF THE PREFERRED EMBODIMENTS

In this connection, it is to be noted that the parts given herein are all by weight.

EXAMPLE 1

| | |
|---|---|
| Ciba Brill Pink F3B (manufactured by Ciba Co., CI Vat Red 2) | 5 parts |
| styrene~n-butylmethacrylate copolymer (weight ratio 7:3) | 100 parts |

The above composition was subjected to heat mixing, then cooled and thereafter pulverized by means of a jet pulverizer, thereby obtaining red toner particles having a particle diameter in the range of from 5 to 20 μm.

3 parts of the thus obtained toner were mixed with 100 parts of spherical iron powder (carrier) having an average particle diameter of 100 μm, the surface thereof being coated with polymethylmethacrylate, and the resulting mixture was stirred, whereby a red developer was prepared.

Next, 10 parts of carbon black were added to 100 parts of epoxy resin and the same was subjected to heat mixing, then cooled and thereafter pulverized by means of a jet pulverizer, thereby obtaining black toner particles having a particle diameter ranging from 5 to 20 μm. 3 parts of the thus obtained toner were mixed with 100 parts of spherical iron powder (carrier) having an average particle diameter of 100 μm, the surface thereof being coated with polytetrafluoroethylene, and the resulting mixture was stirred, whereby a black developer was prepared.

Figure 3:
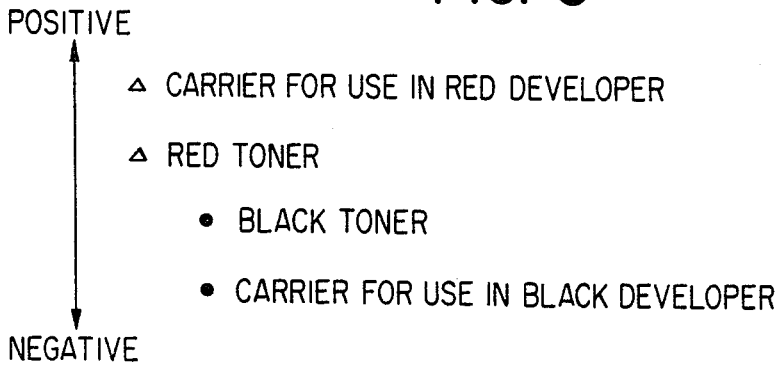
FIG. 3 to FIG. 6 are each views illustrating triboelectrification series of a developer according to this invention.

These two kinds of developers were measured to have the triboelectrification series as illustrated in FIG. 3.

Subsequently, an electrostatic latent image which had previously formed on an electrostatic recording material and electrified with positive and negative portions to voltages such as +600 V and −600 V, was developed first with said red developer and then with said black developer to thus obtain a dichromatic copy. The satisfactory results were achieved thereby even when 8000 copies were reproduced continuously.

EXAMPLE 2

A red developer was obtained according to the same procedure as Example 1 with the exception that the red pigment was replaced with Deep Red Violet (manufactured by Toyo Ink Co., CI Vat Violet 3), and a dichromatic image carrying copy was obtained in the same manner. The satisfactory results were achieved even when 8000 copies were reproduced continuously.

EXAMPLE 3

Two kinds of developers were prepared according to the same procedure as Example 1 with the exception that the red toner was replaced with one comprising 5 parts of Indo Maroom (manufactured by Toyo Ink Co., CI Vat Violet) and 100 parts of epoxy resin, and the black toner was replaced with one comprising 10 parts of carbon black and 100 part of styrene~butadiene copolymer.

Figure 4:
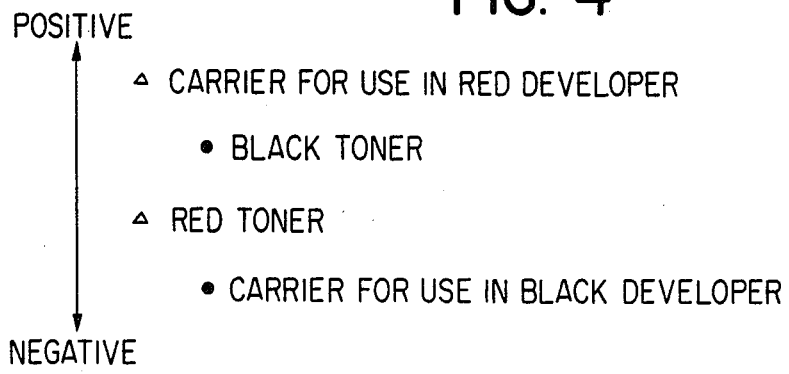

These developers were measured to have the triboelectrification series as illustrated in FIG. 4. Subsequently, a dichromatic image carrying copy was obtained by using these developers and according to the same procedure as Example 1. Satisfactory results were achieved thereby even when 8000 copies were reproduced continuously.

EXAMPLE 4

Figure 6:
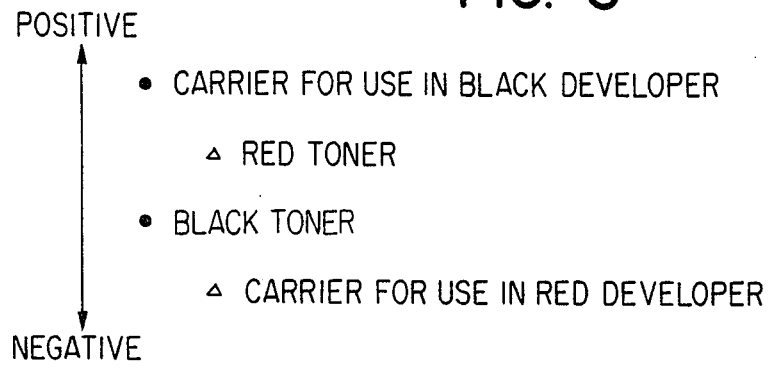
Figure 7:
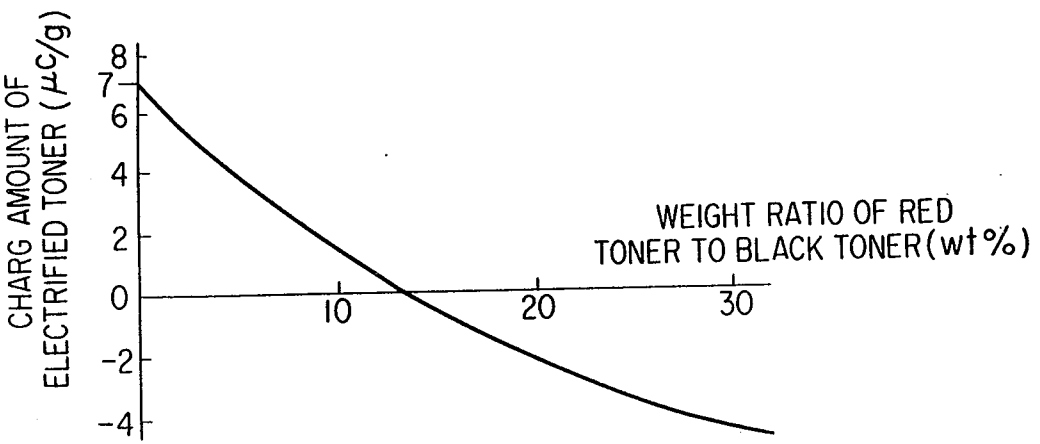
FIG. 7 is a graph illustrating the measured values of the charge amount of the toner as a whole where the red toner is mixed in the black developer having the triboelectrification series shown in FIG. 1.
Figure 8:
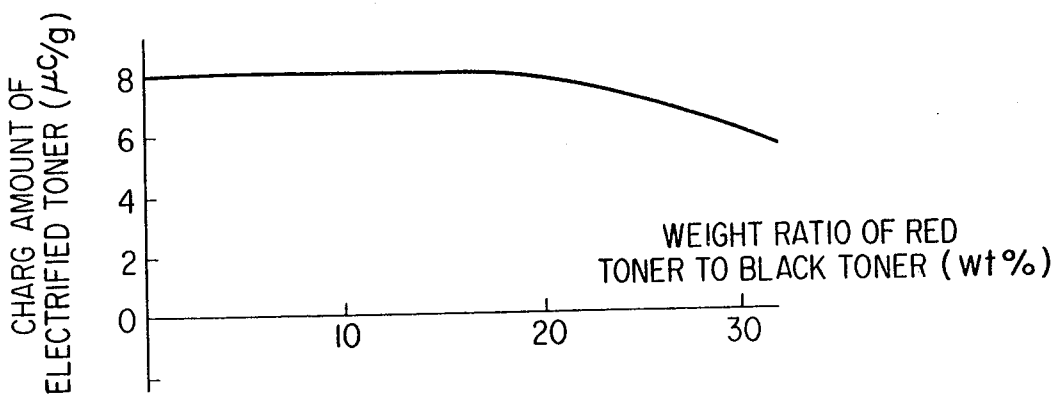
FIG. 8 is a graph illustrating the measured values of the charge amount of the toner as a whole where the red toner is mixed in the black developer having the triboelectrification series shown in FIG. 3.

Two kinds of developers were prepared according to the same procedure as Example 1 with the exception that the carrier employed in the red developer was employed as the carrier for use with the black developer and the carrier employed in the black developer was employed as the carrier for use with the red developer. These developers were measured to have the triboelectrification series as illustrated in FIG. 6. Subsequently, a dichromatic image carrying copy was obtained by using these developers and according to the same procedure as Example 1 with the exception that development was effected first with the black developer and then with the red developer. Satisfactory results were achieved thereby even when 8000 copies were reproduced continuously.

EXAMPLE 5

A mixture of 10 parts of carbon black and 100 parts of styrene~butadiene copolymer was subjected to heat mixing, then cooled and thereafter pulverized to thereby obtain black toner particles having a particle diameter ranging from 5 to 20 μm. 3 parts of the thus obtained toner were mixed with 100 parts of spherical iron powder (carrier) having an average particle diameter of 100 μm, the surface thereof being coated with polymethylmethacrylate, and the resulting mixture was stirred, whereby black developer was prepared. Then the following composition was subjected to heat mixing, cooled and thereafter pulverized to thereby obtain red toner particles having a particle diameter ranging from 5 to 20 μm:

| | |
|---|---|
| Ciba Brill Pink FR (manufactured by Ciba Co., VI Vat Red 1) | 5 parts |
| epoxy resin | 100 parts |

3 parts of the thus obtained toner were mixed with 100 parts of spherical iron powder (carrier) having an average particle diameter of 100 μm, the surface thereof being coated with polytetrafluoroethylene, and the resulting mixture was stirred, whereby a red toner was prepared.

Figure 5:
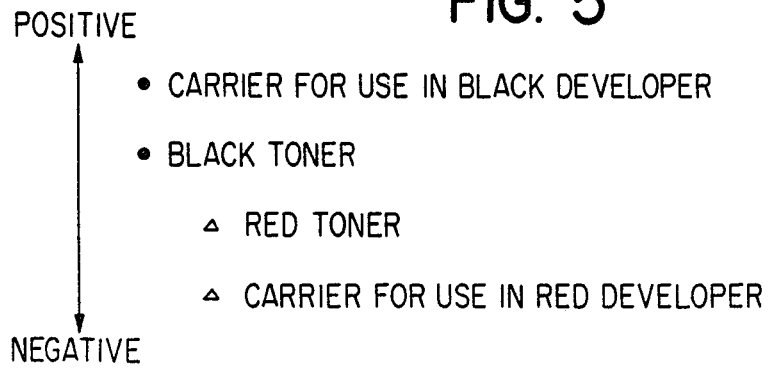

These two kinds of developers were measured to have the triboelectrification series as illustrated in FIG. 5.

Subsequently, a dichromatic image was obtained by using these developers and according to the same procedure as Example 1 with the exception that development was effected first with the black developer and then with the red developer. Satisfactory results were achieved thereby even when 8000 copies were reproduced continuously.

Comparative Example

| | |
|---|---|
| Ciba Brill Pink F3B | 5 parts |
| epoxy resin | 100 parts |

The above composition was subjected to heat mixing, then cooled and thereafter pulverized to thereby obtain red toner particles having a particle diameter ranging from 5 to 20 μm.

3 parts of the thus obtained toner was added to 100 parts of spherical iron powder (carrier) having an average particle diameter of 100 μm, the surface thereof being coated with styrene~butadiene copolymer, and the resulting mixture was stirred, whereby a red developer was prepared.

Then 5 parts of carbon black was added to 100 parts of polymethylmethacrylate, and the same was subjected to heat mixing, then cooled and thereafter pulverized to thereby obtain black toner particles having a particle diameter ranging from 5 to 20 μm. 3 parts of the thus obtained toner were mixed with 100 parts of spherical iron powder (carrier) having an average particle diameter of 100 μm, the surface thereof being coated with styrene~methylmethacrylate copolymer, and the resulting mixture was stirred, whereby a black developer was prepared.

Figure 1:
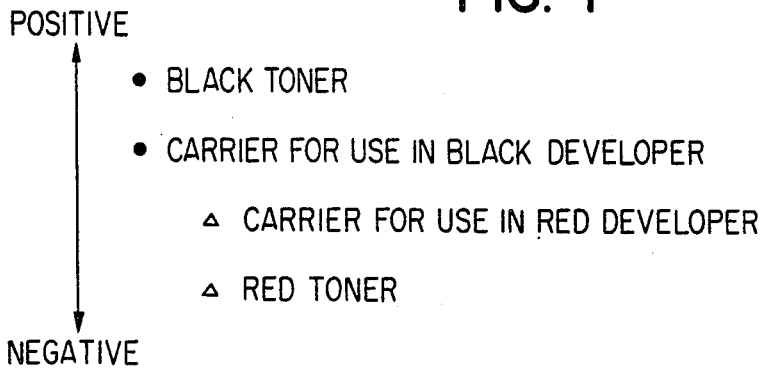
FIG. 1 and FIG. 2 are views illustrating the triboelectrification series of two conventionally used kinds of developers.
Figure 2:
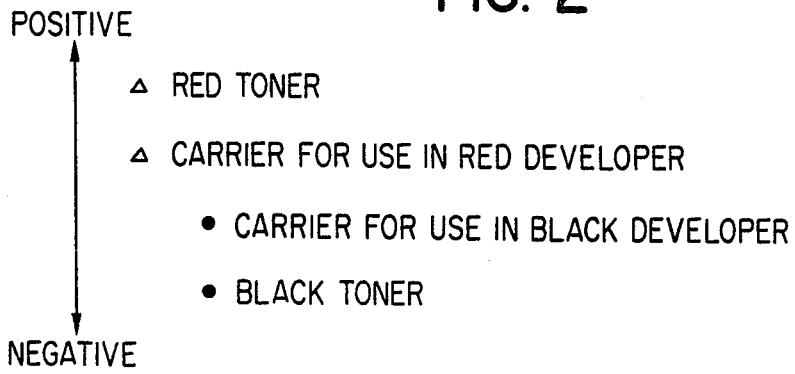

These developers were measured to have the triboelectrification series illustrated in FIG. 1. Subsequently, a dichromatic image was obtained by using these developers and according to the same procedure as Example 1. The results showed that there were obtained only copies whose red image density was poor.

What is claimed is:

1. A process for dichromatically developing a single electrostatic latent image having positively charged area or areas and negatively charged area or areas, comprising:

providing a set of first and second, separate, dry developer compositions, said first dry developer composition consisting essentially of a first mixture of first toner particles and first carrier particles adapted to be triboelectrically charged in opposite polarities, said second dry developer composition consisting essentially of a second mixture of second toner particles and second carrier particles adapted to be triboelectrically charged in opposite polarities, said first and second toner particles being respectively different in color and also being adapted to be triboelectrically charged in opposite polarities relative to each other by contact with their respective associated carrier particles, said first carrier particles being triboelectrically charged by contact with said first toner particles to a positive potential higher than those of said first and second toner particles and said second carrier particles being triboelectrically charged by friction with said second toner particles to a negative potential lower than those of said first and second toner particles: applying to said electrostatic latent image one of said dry developer compositions so that the charged toner particles of said one dry developer composition adhere to the area or areas of said electrostatic latent image having a first polarity opposite to the polarity of said charged toner particles of said one dry developer composition whereby to develop said area or areas with a first color, then applying to said electrostatic latent image the other of said dry developer compositions so that the charged toner particles of said other dry developer composition adhere to the area or areas of said electrostatic latent image of a second polarity opposite to the polarity of said charged toner particles of said other dry developer composition whereby to develop the latter area or areas with a second color.

* * * * *